US008796652B2

(12) United States Patent
Bezel et al.

(10) Patent No.: US 8,796,652 B2
(45) Date of Patent: Aug. 5, 2014

(54) LASER SUSTAINED PLASMA BULB INCLUDING WATER

(71) Applicant: KLA-Tencor Corporation, Milpitas, CA (US)

(72) Inventors: Ilya Bezel, Sunnyvale, CA (US); Anatoly Shchemelinin, Pleasanton, CA (US); Matthew Alan Panzer, San Jose, CA (US)

(73) Assignee: KLA-Tencor Corporation, Milpitas, CA (US)

( * ) Notice: Subject to any disclaimer, the term of this patent is extended or adjusted under 35 U.S.C. 154(b) by 0 days.

(21) Appl. No.: 13/790,084

(22) Filed: Mar. 8, 2013

(65) Prior Publication Data

US 2014/0042336 A1 Feb. 13, 2014

Related U.S. Application Data

(60) Provisional application No. 61/680,786, filed on Aug. 8, 2012.

(51) Int. Cl.
*H05G 2/00* (2006.01)

(52) U.S. Cl.
USPC ..... 250/504 R; 313/231.01; 313/231.31; 313/231.51; 313/231.61; 313/112

(58) Field of Classification Search
CPC ..... H05H 1/34; H05H 1/24; H05G 2/008; G02B 21/16
USPC ..... 250/504 R; 313/231.01, 231.31, 231.51, 313/231.61, 112
See application file for complete search history.

(56) References Cited

U.S. PATENT DOCUMENTS 7,705,331 B1 4/2010 Kirk et al.
2013/0181595 A1* 7/2013 Bezel et al. ..... 313/112

* cited by examiner

*Primary Examiner* — Michael Maskell
(74) *Attorney, Agent, or Firm* — Spano Law Group; Joseph S. Spano

(57) ABSTRACT

A wafer inspection system includes a laser sustained plasma (LSP) light source that generates light with sufficient radiance to enable bright field inspection. Reliability of the LSP light source is improved by introducing an amount of water into the bulb containing the gas mixture that generates the plasma. Radiation generated by the plasma includes substantial radiance in a wavelength range below approximately 190 nanometers that causes damage to the materials used to construct the bulb. The water vapor acts as an absorber of radiation generated by the plasma in the wavelength range that causes damage. In some examples, a predetermined amount of water is introduced into the bulb to provide sufficient absorption. In some other examples, the temperature of a portion of the bulb containing an amount of condensed water is regulate to produce the desired partial pressure of water in the bulb.

20 Claims, 7 Drawing Sheets

LASER SUSTAINED PLASMA BULB INCLUDING WATER

CROSS REFERENCE TO RELATED APPLICATION

The present application for patent claims priority under 35 U.S.C. §119 from U.S. provisional patent application Ser. No. 61/680,786, entitled "Water-Containing Bulbs For Reduced Bulb Degradation In Laser-Sustained Plasma Sources," filed Aug. 8, 2012, the subject matter of which is incorporated herein by reference.

TECHNICAL FIELD

The described embodiments relate to optical metrology and inspection systems for microscopy, and more particularly to optical metrology and inspection systems involving laser sustained plasma radiation sources.

BACKGROUND INFORMATION

Semiconductor devices such as logic and memory devices are typically fabricated by a sequence of processing steps applied to a specimen. The various features and multiple structural levels of the semiconductor devices are formed by these processing steps. For example, lithography among others is one semiconductor fabrication process that involves generating a pattern on a semiconductor wafer. Additional examples of semiconductor fabrication processes include, but are not limited to, chemical-mechanical polishing, etch, deposition, and ion implantation. Multiple semiconductor devices may be fabricated on a single semiconductor wafer and then separated into individual semiconductor devices.

Inspection processes are used at various steps during a semiconductor manufacturing process to detect defects on wafers to promote higher yield. When inspecting specular or quasi-specular surfaces such as semiconductor wafers bright field (BF) and dark field (DF) modalities may be used, both to perform patterned wafer inspection and defect review. In BF inspection systems, collection optics are positioned such that the collection optics capture a substantial portion of the light specularly reflected by the surface under inspection. In DF inspection systems, the collection optics are positioned out of the path of the specularly reflected light such that the collection optics capture light scattered by objects on the surface being inspected such as microcircuit patterns or contaminants on the surfaces of wafers. Viable inspection systems, particularly BF inspection systems, require high radiance illumination and a high numerical aperture (NA) to maximize the defect sensitivity of the system.

Current wafer inspection systems typically employ illumination sources of deep ultraviolet (DUV) radiation with wavelengths as short as 260 nanometers with a high numerical aperture (NA). In general, the defect sensitivity of an inspection system is proportional to the wavelength of the illumination light divided by the NA of the objective. Without further improvement in NA, the overall defect sensitivity of current inspection tools is limited by the wavelength of the illumination source.

In some examples of BF inspection systems, illumination light may provided by an arc lamp. For example, electrode based, relatively high intensity discharge arc lamps are used in inspection systems. However, these light sources have a number of disadvantages. For example, electrode based, relatively high intensity discharge arc lamps have radiance limits and power limits due to electrostatic constraints on current density from the electrodes, the limited emissivity of gases as black body emitters, the relatively rapid erosion of electrodes made from refractory materials due to the presence of relatively large current densities at the cathodes, and the inability to control dopants (which can lower the operating temperature of the refractory cathodes) for relatively long periods of time at the required emission current.

To avoid the limitations of electrode based illumination sources, incoherent light sources pumped by a laser (e.g., laser sustained plasma) have been developed. Exemplary laser sustained plasma systems are described in U.S. Pat. No. 7,705,331 assigned to KLA-Tencor Corp., which is incorporated by reference as if fully set forth herein. Laser sustained plasmas are produced in high pressure bulbs surrounded by a working gas at lower temperature than the laser plasma. Substantial radiance improvements are obtained with laser sustained plasmas. Atomic and ionic emission in these plasmas generates wavelengths in all spectral regions, including shorter than 200 nm when using either continuous wavelength or pulsed pump sources. Excimer emission can also be arranged in laser sustained plasmas for wavelength emission at 171 nm (e.g., xenon excimer emission). Hence, a simple gas mixture in a high pressure bulb is able to sustain wavelength coverage at deep ultraviolet (DUV) wavelengths with sufficient radiance and average power to support high throughput, high resolution BF wafer inspection.

Development of laser sustained plasmas has been hampered by reliability issues related to degradation of the bulb containing the gas mixture. Traditional plasma bulbs of laser sustained light sources are formed from fused silica glass. Fused silica glass absorbs light at wavelengths shorter than approximately 170 nm. The absorption of light at these small wavelengths leads to rapid damage of the plasma bulb, which in turn reduces optical transmission of light in the 190-260 nm range. In some examples, substantial emission of radiation in the vacuum ultraviolet range (VUV) causes the bulb material to degrade. VUV light with photon energies in excess of 6.5 eV (~190 nm) causes rapid damage to materials used to construct the LSP lamphouse, and most importantly, to the material of the bulb itself. Fused silica glass undergoes rapid solarization, transmission loss, compaction-rarefaction and related stress, micro-channeling, and other damage that leads to reduced source output, loss of structural integrity (e.g., explosions), overheating, melting, and other adverse results.

FIG. 1 is illustrative of a plot 10 depicting the percentage of plasma emission absorbed by the bulb wall absorption as a function of wavelength for various bulb configurations and operating scenarios. Plotline 15 illustrates the absorption of an unexposed bulb. Plotline 14 illustrates a bulb containing Xenon gas after operation for one hour at five kilowatts output power, five hours at four kilowatts output power, and less than one hour at three kilowatts output power. Plotline 13 illustrates a bulb containing Krypton gas after operation for seven hours at four kilowatts output power. Plotline 12 illustrates a bulb containing Argon gas after operation for less than one hour at three kilowatts output power. Plotline 11 illustrates a bulb containing Krypton gas after operation for one hour at three kilowatts output power and two hours at four kilowatts output power. As illustrated in plot 10, only a few hours of operation results in significant absorption losses, particularly in the wavelength range between 200 nanometers and 260 nanometers.

In some examples, VUV-absorptive coatings are used to block VUV in ozone-free bulbs. The material composition of the coating determines the absorption profile of the coating. For a LSP to be an effective illumination source for inspection, an absorptive coating should not block light with wavelengths longer than 190 nm (DUV light) and absorb light with wavelengths shorter than 190 nm (VUV light). In this manner, shorter wavelength VUV light that causes damage to the bulb is absorbed without absorbing DUV radiation that is desired for inspection. Unfortunately, existing materials do not have a sharp absorption cutoff near 190 nanometers. Existing coating materials either absorb light in a desirable illumination range from 190-260 nanometers, or transmit substantial amounts of light with wavelengths shorter that 190 nm. Similar problems are encountered by trying to match the absorption edge of the coatings to radiation in the band between 260-450 nanometers. Moreover, the protective coating itself is subject to damage and early failure from exposure to VUV light.

As inspection systems with laser sustained plasma illumination sources are developed, reliability becomes a limiting factor in maintaining system uptime. Thus, improved methods and systems for extending the lifetime of laser sustained plasma sources are desired.

SUMMARY

A metrology or inspection system includes a laser sustained plasma (LSP) light source that generates light. In one aspect, reliability of the LSP light source is improved by introducing an amount of water into the bulb containing the gas mixture that generates the plasma. Radiation generated by the plasma includes substantial radiance in a wavelength range below approximately 190 nanometers that causes damage to the materials used to construct the bulb. The water vapor acts as an absorber of radiation generated by the plasma in the wavelength range that causes damage.

In some embodiments, a predetermined amount of water is introduced into the bulb to provide sufficient absorption.

In some other embodiments, the temperature of a portion of the bulb containing an amount of condensed water is regulated to produce a desired partial pressure of water vapor in the bulb.

In some other embodiments, the water vapor concentration in the plasma bulb is determined by the water vapor present in a gas mixture flowing through the plasma bulb.

In another aspect, the water vapor concentration in the plasma bulb is actively controlled. In one embodiment, the temperature of the lowest temperature point of the bulb where the condensed water tends to collect is actively controlled. In another embodiment, the water vapor concentration in the plasma bulb can be actively controlled by controlling the concentration of water vapor present in a working gas mixture flowing through the plasma bulb.

The foregoing is a summary and thus contains, by necessity, simplifications, generalizations and omissions of detail; consequently, those skilled in the art will appreciate that the summary is illustrative only and is not limiting in any way. Other aspects, inventive features, and advantages of the devices and/or processes described herein will become apparent in the non-limiting detailed description set forth herein.

as an indicator of bulb glass degradation.

Figure 4:
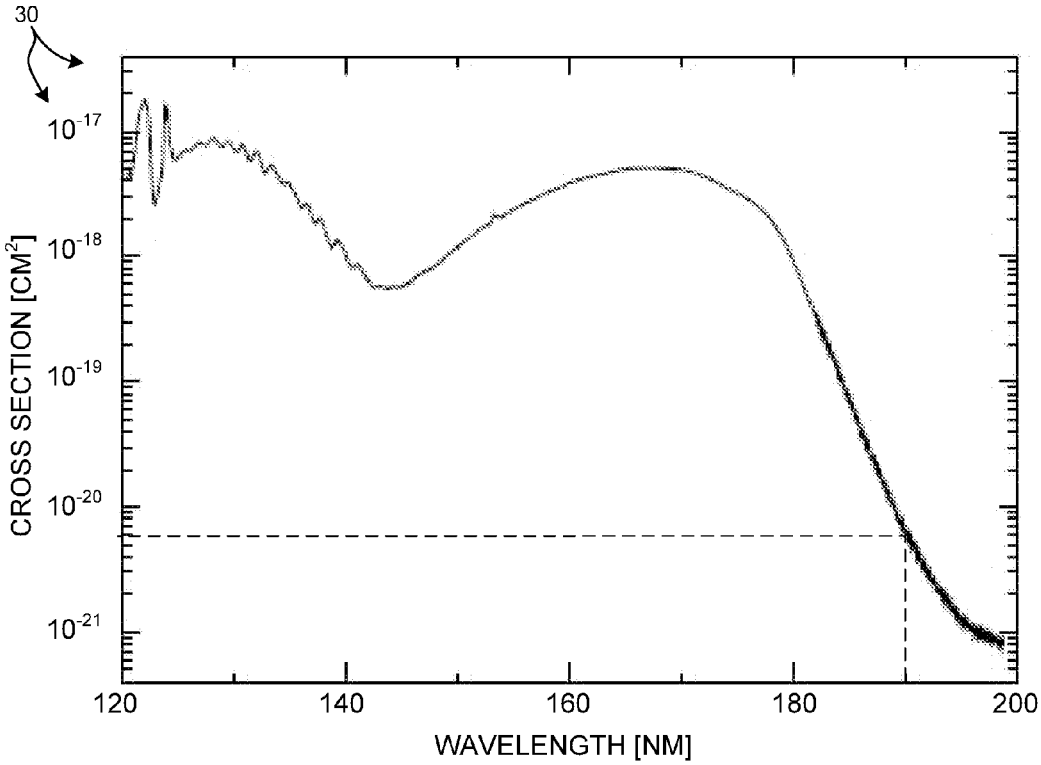

FIG. 4 is illustrative of a plot of the absorption cross section of water at 295 Kelvin over a range of wavelengths between 120 nanometers and 200 nanometers.

Figure 5:
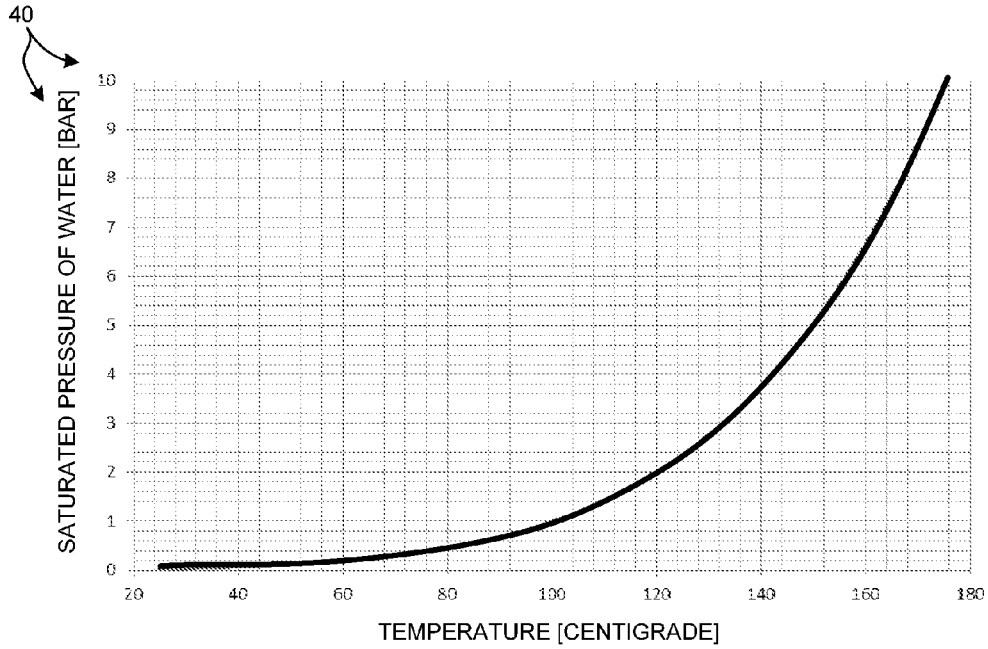

FIG. 5 is a plot illustrative of the saturated pressure of water for a range of temperatures.

Figure 6:
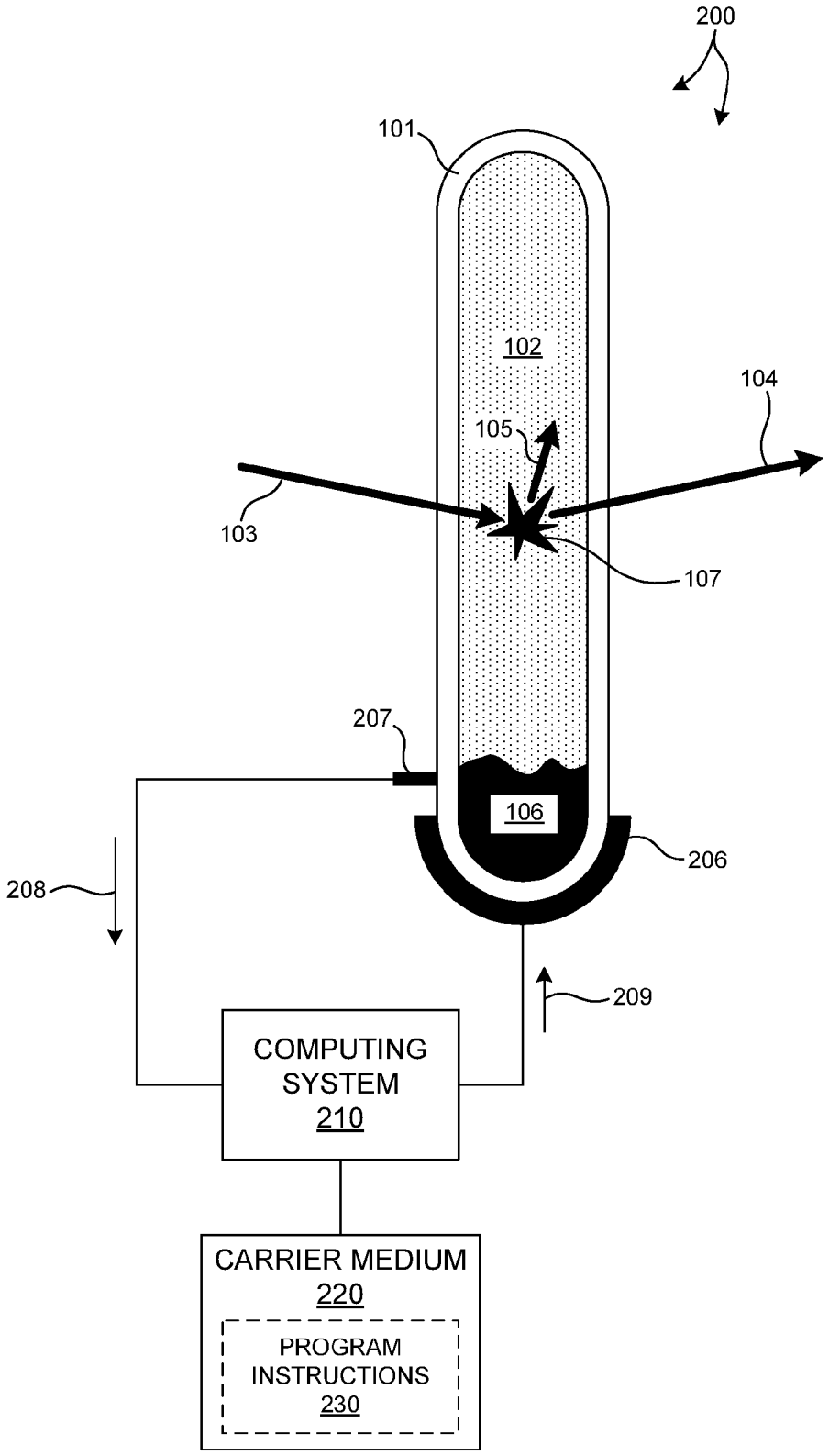

FIG. 6 illustrates plasma bulb 200 in another embodiment of the present invention.

Figure 7:
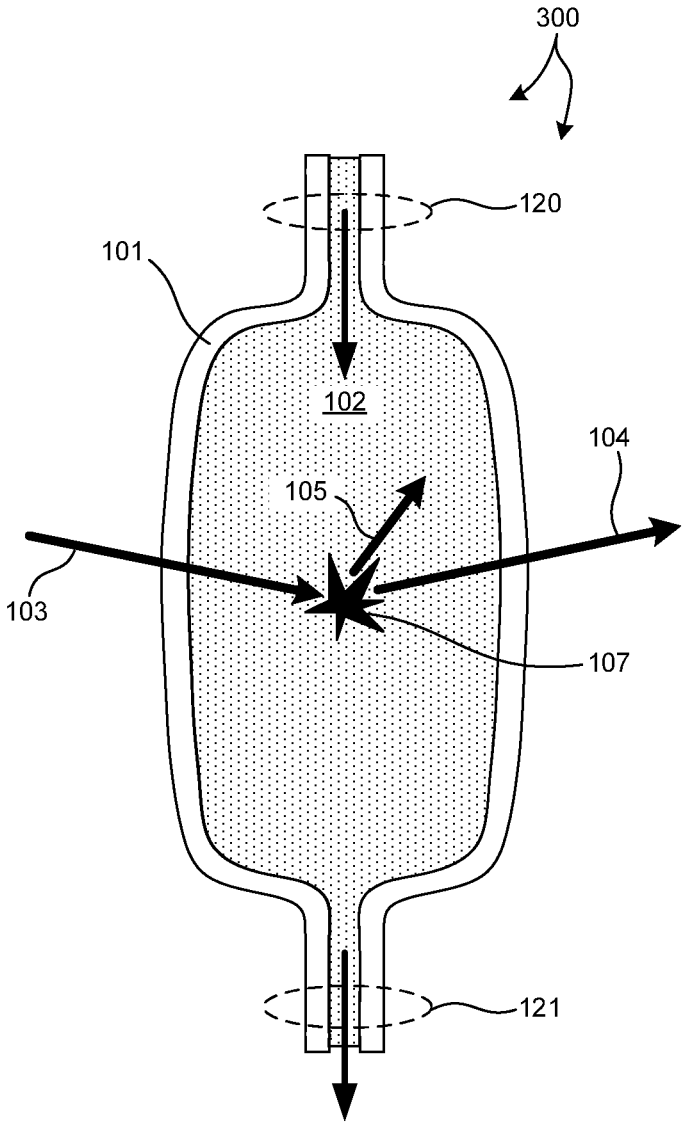

FIG. 7 illustrates plasma bulb 300 in another embodiment of the present invention.

Figure 8:
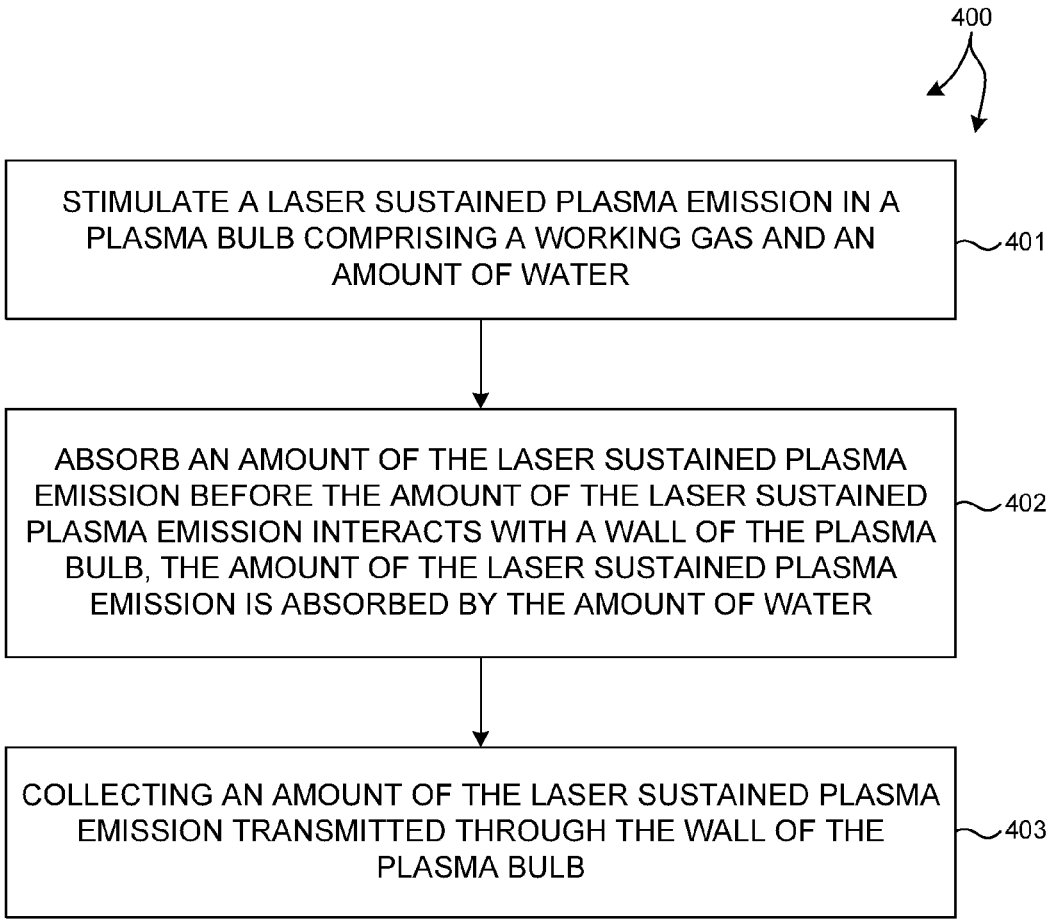

FIG. 8 is a flowchart illustrative of one exemplary method 400 suitable for implementation in any system including a plasma bulb of the present invention.

DETAILED DESCRIPTION

Reference will now be made in detail to background examples and some embodiments of the invention, examples of which are illustrated in the accompanying drawings.

Laser-sustained plasma light sources (LSPs) are capable of producing high-power broadband light suitable for metrology and inspection applications. LSPs operate by focusing laser radiation into a working gas volume to excite the gas into a plasma state that emits light. This effect is typically referred to as "pumping" the plasma with the laser radiation. A plasma bulb or gas cell is configured to contain the working gas species as well as the generated plasma. In some embodiments, a LSP is maintained with an infrared laser pump having a beam power on the order of several kilowatts. The laser beam is focused into a volume of a low or medium pressure working gas contained by a gas cell. The absorption of laser power by the plasma generates and sustains the plasma, for example, at plasma temperatures between 10,000 Kelvin and 20,000 Kelvin.

Figure 1:
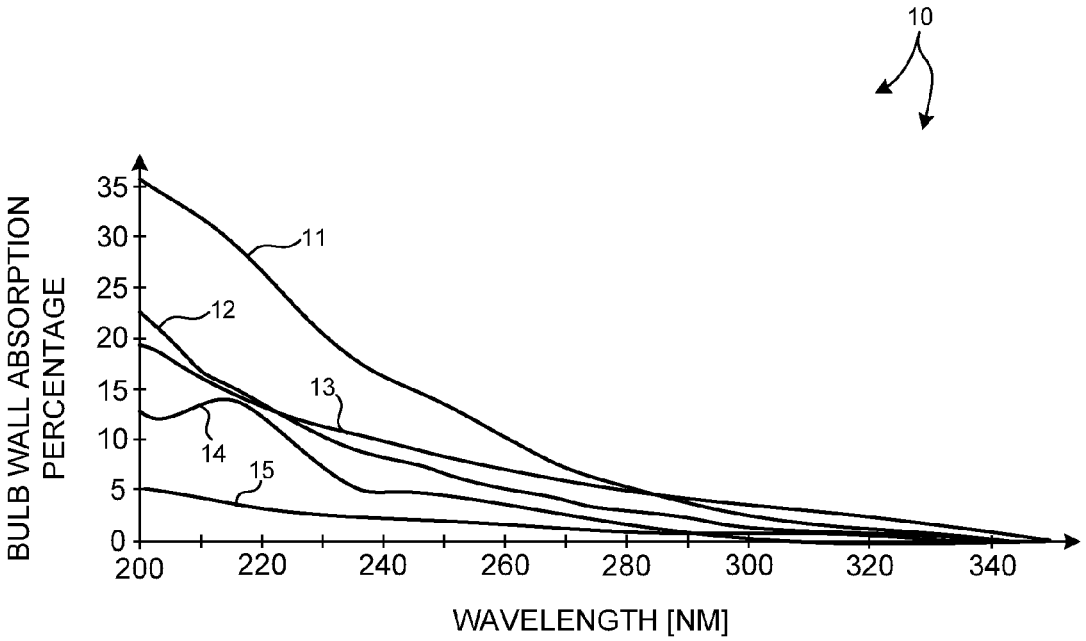
FIG. 1 is illustrative of a plot 10 depicting the percentage of plasma emission absorbed by the bulb wall absorption as a function of wavelength for various bulb configurations and operating scenarios.
Figure 2:
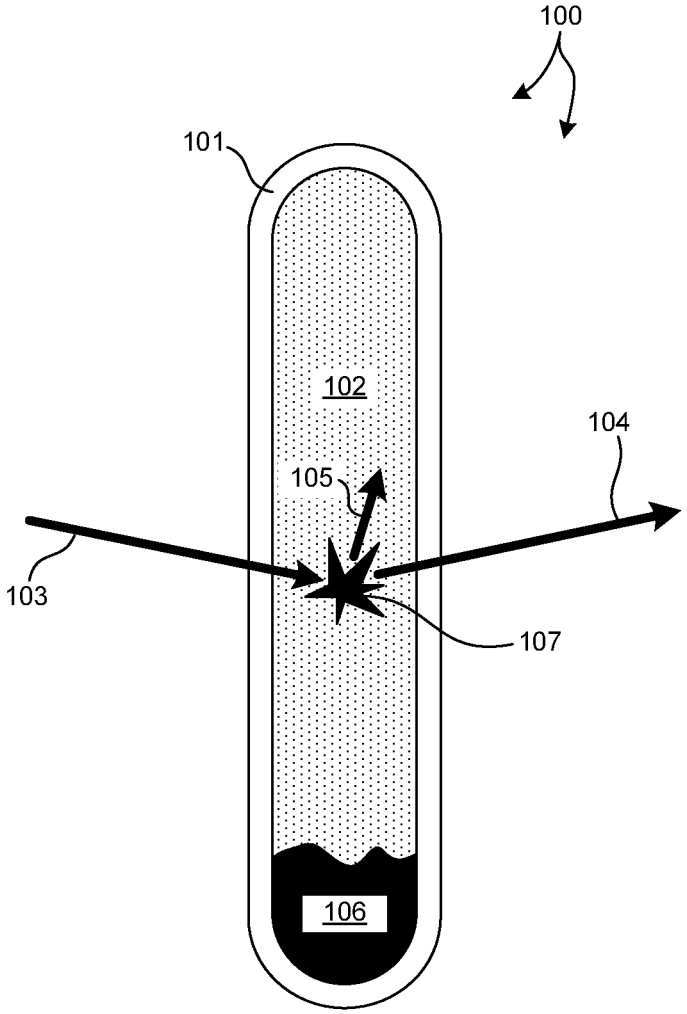
FIG. 2 illustrates a plasma bulb 100 configured in accordance with one embodiment of the present invention.

FIG. 2 illustrates a plasma bulb 100 configured in accordance with one embodiment of the present invention. Plasma bulb 100 includes at least one wall 101 formed from a material (e.g., glass) that is substantially transparent to at least a portion of the incoming light 103 from a pumping laser source (not shown). Similarly, the at least one wall is also substantially transparent to at least a portion of the collectable illumination 104 (e.g., IR light, visible light, ultraviolet light) emitted by the plasma 107 sustained within the plasma bulb 100. For example, the wall 101 may be transparent to a particular spectral region of the broadband emission 104 from the plasma 107.

Plasma bulb 100 may be formed from a variety of glass or crystalline materials. In one embodiment, the glass bulb may be formed from fused silica glass. In further embodiments, the plasma bulb 100 may be formed from a low OH content fused synthetic quartz glass material. In other embodiments, the plasma bulb 100 may be formed high OH content fused synthetic silica glass material. For example, the plasma bulb 100 may include, but is not limited to, SUPRASIL 1, SUPRASIL 2, SUPRASIL 300, SUPRASIL 310, HERALUX PLUS, and HERALUX-VUV. Various glasses suitable for implementation in the plasma bulb of the present invention are discussed in detail in A. Schreiber et al., Radiation Resistance of Quartz Glass for VUV Discharge Lamps, J. Phys. D: Appl. Phys. 38 (2005), 3242-3250, which is incorporated herein in the entirety. In some embodiments, the plasma bulb 100 may be formed from a crystalline material such as a crystalline quartz material or a sapphire material.

In the illustrated embodiment, plasma bulb 100 includes a cylindrical shape with spherical ends. In some embodiments, plasma bulb 100 includes any of a substantially spherical shape, a substantially cylindrical shape, a substantially ellipsoidal shape, and a substantially prolate spheroid shape. These shapes are provided by way of non-limiting example. However, many other shapes may be contemplated.

It is contemplated herein that the refillable plasma bulb 100 may be utilized to sustain a plasma in a variety of gas environments. In one embodiment, the working gas 102 of the plasma bulb 100 may include an inert gas (e.g., noble gas or non-noble gas) or a non-inert gas (e.g., mercury) or their mixtures. For example, it is anticipated herein that the volume of working gas of the present invention may include argon. For instance, the working gas may include a substantially pure argon gas held at pressure in excess of 5 atm. In another instance, the working gas may include a substantially pure krypton gas held at pressure in excess of 5 atm. In a general sense, the plasma bulb 100 may be filled with any gas known in the art suitable for use in laser sustained plasma light sources. In addition, the working gas may include a mixture of two or more gases. By way of non-limiting example, the working gas may include any one or combination of Ar, Kr, Xe, He, Ne, $N_2$, $Br_2$, $Cl_2$, $I_2$, $H_2O$, $O_2$, $H_2$, $CH_4$, NO, $NO_2$, $CH_3OH$, $C_2H_5OH$, $CO_2$, $NH_3$ one or more metal halides, a Ne/Xe mixture, an Ar/Xe mixture, a Kr/Xe mixture, an Ar/Kr/Xe mixture, an ArHg mixture, a KrHg mixture, and a XeHg mixture. In a general sense, the present invention should be interpreted to extend to any light pump plasma generating system and should further be interpreted to extend to any type of working gas suitable for sustaining a plasma within a plasma bulb.

In one novel aspect, an amount of water 106 is added to the working gas 102. As illustrated in FIG. 2, water 106 includes an amount of condensed water vapor. However, in addition, water 106 includes an amount of water vapor mixed with working gas 102. The addition of water 106 effectively absorbs an amount of vacuum-ultra-violet (VUV) light 105 emitted from plasma 107 before it reaches wall 101 of plasma bulb 100. VUV light includes wavelengths shorter than about 190 nm. In this manner, the amount of harmful VUV light that reaches the wall 101 of the plasma bulb or gas cell is minimized. This significantly reduces VUV-induced damage to the material of the lamp. In addition, VUV damage to all other components of the LSP illuminator is reduced.

For purposes of this patent document, water used as part of the working gas or fluid in a plasma bulb includes all isotopes of water (e.g., H2O, HDO, D2O, etc.).

Figure 3:
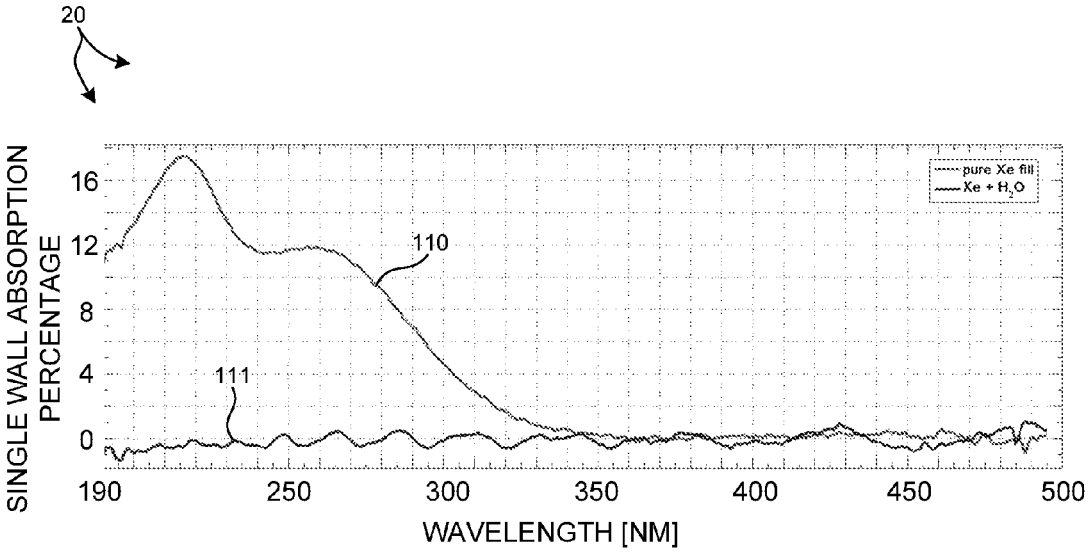
FIG. 3 is a plot 20 illustrative of the induced absorption of two exemplary single wall plasma bulbs.

FIG. 3 is a plot 20 illustrative of the induced absorption of two single wall plasma bulbs as an indicator of bulb glass degradation. Both plasma bulbs were filled with 15 atm of xenon gas. Both bulbs were run at 3 kW of pump power for thirty minutes. One plasma bulb was tested with pure xenon gas. Plotline 110 illustrates the measured absorption percentage for a plasma bulb filled with xenon gas. The spectral profile illustrated by plotline 110 shows features at 214 nm and 260 nm corresponding to E' and NBOHC. These are characteristics of broken Si—O bonds and indicate degradation of the wall 101 of the plasma bulb 100. The pure xenon-filled bulb exhibits an absorption pattern typical for cylindrical bulb degradation with high absorption loss in the center of the bulb, where the VUV light intensity is the highest, and a dip at the equator, where higher glass temperatures promote annealing and healing of the defects.

The second plasma bulb included an additional amount of water added to the pure xenon gas. The partial pressure of the added water was approximately one atmosphere when evaporated. Plotline 111 illustrates the measured absorption percentage for a plasma bulb filled with a mixture of xenon gas and water. The spectral profile confirms that the water-containing bulb underwent little to no solarization. The absence of NBOHC absorption is consistent with the observed absence of red NBOHC fluorescence in water-containing plasma bulbs.

FIG. 4 is illustrative of a plot of the absorption cross section of water at 295 Kelvin over a range of wavelengths between 120 nanometers and 200 nanometers. The illustrated plot is presented in W. H. Parkinson and K. Yoshino, "Absorption cross-section measurements of water vapor in the wavelength region 181-199 nm," Chemical Physics 294 (2003) 31-35, which is incorporated by reference as if fully set forth herein. As illustrated in FIG. 4, water vapor has an absorption cutoff between approximately 180 nanometers and approximately 200 nanometers. In particular, water vapor exhibits a sharp cutoff between approximately 180 nanometers and approximately 190 nanometers. This is important because wavelengths in the spectral region between 190 nanometers and 200 nanometers are desirable for many applications for laser sustained plasma light sources, including metrology and inspection. However, suppression of clearly harmful wavelengths below approximately 180 nanometers is required to realize a reliable plasma bulb.

As illustrated in FIG. 4, as water concentration increases, further attenuation of wavelengths less than 180 nanometers may be achieved. However, attenuation of wavelengths between approximately 190 nanometers and 200 nanometers will also increase, and vice-versa. Hence, a design optimization must be performed to find an optimal balance between suppression of clearly harmful wavelengths below approximately 180 nanometers and transmission of wavelengths longer than approximately 190 nanometers. It should be recognized that light in the 190-200 nm wavelength range is also damaging to the glass or crystalline bulb material. In some applications that do not require light collection in this spectral region, further attenuation is desirable and may be achieved by an additional increase in water concentration.

For a particular plasma bulb the desired amount of water concentration may be estimated with the aid of the plot illustrated in FIG. 4. The required atomic density of water may be expressed as the absorption coefficient divided by the desired absorption cross section of the water. For example, for a typical plasma bulb having a one centimeter internal radius (i.e., path length of one centimeter from plasma 107 to wall 101) including an amount of water vapor with an approximate absorption coefficient of 0.05 near 190 nanometers and a desired absorption cross-section of $\sim 5 \cdot 10^{-21}$ $cm^2$ (the absorption cross section at 190 nanometers illustrated in FIG. 4), a water concentration of approximately $\sim 10^{19}$ $cm^{-3}$ (~0.4 bar at operating temperatures) would be suitable. This concentration would enable extinction of most VUV radiation (shorter than 180 nm) with a significant margin of safety.

FIG. 5 is a plot illustrative of the saturated pressure of water for a range of temperatures. As illustrated in FIG. 5, the maintenance of 0.4 bar of water in the evaporated state requires a temperature of approximately 70 degree Centigrade. Such temperatures are easily achieved in a typical plasma bulb.

Although the partial pressure of water vapor in a plasma bulb may be any useful value, in some embodiments, the partial pressure of water vapor in the plasma bulb is greater than 0.001 bar. In some embodiments, the partial pressure of water vapor in the plasma bulb is greater than 0.01 bar. In some embodiments, the partial pressure of water vapor in the plasma bulb is greater than 0.1 bar. In addition, in most practical applications, the partial pressure in the aforementioned embodiments is less than 10 bar.

In some embodiments, such as the embodiment illustrated in FIG. 2, the water concentration in the bulb can be changed by controlling the amount of water placed in the bulb. In this manner, the concentration of water vapor is fixed for a fixed operating temperature.

However, in one further aspect, the water vapor concentration in the bulb can be actively controlled. In one embodiment, the temperature of the lowest temperature point of the bulb where the condensed water tends to collect is actively controlled. FIG. 6 illustrates plasma bulb 200 in another embodiment of the present invention. As illustrated in FIG. 6, plasma bulb 200 includes similar, like numbered elements described with reference to FIG. 2. However, in addition, plasma bulb 200 includes a heating element 206 (e.g., resistive heater) located near the area of plasma bulb 200 where an amount of condensed water 106 tends to collect. In this manner, heating element 206 can heat the amount of condensed water 106 and increase the partial pressure of water vapor in the gas mixture 102. As discussed, herein, the increase in partial pressure of water vapor in the gas mixture increases the suppression of VUV radiation emitted from plasma 107. Plasma bulb 200 also includes a temperature sensor 207 located to measure the temperature of the amount of condensed water 106. Temperature sensor 207 may be any temperature sensor suitable for measuring the temperature of the condensed water (e.g., infrared sensor, thermocouple mounted to the wall of the plasma bulb near the pool of condensed water vapor, etc.).

The embodiment of plasma bulb 200 depicted in FIG. 6 also includes one or more computing systems 210 employed to receive and analyze the output signals 208 indicative of the temperature of the pool of condensed water and determine a control signal 209 communicated to heating element 206. In response to the control signal 209, heating element 206 adds heat to the pool of condensed water in accordance with the control signal 209 generated by computing system 210.

In some other embodiments, temperature sensor 207 may be located in other areas of plasma bulb 200, (e.g., the middle or opposite end of plasma bulb 200). In some embodiments a number of temperature sensors may be employed in different locations and computing system 210 is configured to receive multiple temperature signals and determine the control signal based on an aggregate of the temperature readings of each of these sensors. In some other embodiments, one or more pressure sensors may be employed instead of, or in addition to, temperature sensor 207. In these embodiments, computing system 210 is configured to receive one or more pressure signals and determine the control signal based at least in part on the one or more pressure signals.

It should be recognized that the various steps described throughout the present disclosure may be carried out by a single computer system 210 or, alternatively, a multiple computer system 210. Moreover, different subsystems of a metrology system employing a laser sustained plasma light source may include a computer system suitable for carrying out at least a portion of the steps described herein. Therefore, the description presented herein should not be interpreted as a limitation on the present invention but merely an illustration. Further, the one or more computing systems 210 may be configured to perform any other step(s) of any of the method examples described herein.

The computer system 210 may be configured to receive and/or acquire data or information from the subsystems of the system (e.g., sensor 207, heating element 206, and the like) by a transmission medium that may include wireline and/or wireless portions. In this manner, the transmission medium may serve as a data link between the computer system 210 and other subsystems. Further, the computing system 210 may be configured to receive parameters or instructions via a storage medium (i.e., memory). For instance, the temperature signals 208 generated by temperature sensor 207 may be stored in a permanent or semi-permanent memory device (e.g., carrier medium 220). In this regard, the signals may be imported from an external system.

Moreover, the computer system 210 may send data to external systems via a transmission medium. The transmission medium may include wireline and/or wireless portions. In this manner, the transmission medium may serve as a data link between the computer system 210 and other subsystems or external systems. For example, computer system 210 may send results generated by computer system 210 to external systems or to other subsystems of via a transmission medium.

The computing system 210 may include, but is not limited to, a personal computer system, mainframe computer system, workstation, image computer, parallel processor, or any other device known in the art. In general, the term "computing system" may be broadly defined to encompass any device having one or more processors, which execute instructions from a memory medium.

Program instructions 230 implementing methods such as those described herein may be transmitted over or stored on carrier medium 220. The carrier medium may be a transmission medium such as a wire, cable, or wireless transmission link. The carrier medium may also include a computer-readable medium such as a read-only memory, a random access memory, a magnetic or optical disk, or a magnetic tape.

In another aspect, the water vapor concentration in the plasma bulb can be actively controlled by controlling the water concentration of a gas mixture flowing through the plasma bulb. FIG. 7 illustrates plasma bulb 300 in another embodiment of the present invention. As illustrated in FIG. 7, plasma bulb 300 includes similar, like numbered elements described with reference to FIG. 2. However, plasma bulb 300 includes an entrance port 120 and an exit port 121 and gas mixture 102 including an amount of water vapor flows through plasma bulb 300 during operation. The amount of water vapor mixed in gas mixture 102 determines the water concentration within plasma bulb 300 at a given time.

FIG. 8 illustrates a method 400 suitable for implementation in any system including a plasma bulb of the present invention. In one aspect, it is recognized that data processing blocks of method 400 may be carried out via a pre-programmed algorithm stored as part of program instructions 230 and executed by one or more processors of computing system 210. While the following description is presented in the context of plasma bulb 200 depicted in FIG. 6, it is recognized herein that the particular structural aspects of plasma bulb 100 do not represent limitations and should be interpreted as illustrative only.

In block 401, a laser sustained plasma emission is stimulated in a plasma bulb comprising a working gas and an amount of water. In block 402, an amount of the laser sustained plasma emission is absorbed by an amount of water before the amount of the laser sustained plasma emission interacts with a wall of the plasma bulb. In block 403, an amount of the laser sustained plasma emission transmitted through the wall of the plasma bulb is collected. In another block (not shown) the amount of water vapor present in the plasma bulb is controlled by controlling a temperature of the plasma bulb in a region of the plasma bulb that contains the amount of condensed water vapor.

In another aspect of the present invention, the illumination source used to pump the plasma 206 of the plasma cell 200 may include one or more lasers. In a general sense, the illumination source may include any laser system known in the art. For instance, the illumination source may include any laser system known in the art capable of emitting radiation in the infrared, visible, or ultraviolet portions of the electromagnetic spectrum. In some embodiments, the illumination source includes a laser system configured to emit pulsed laser radiation. In some other embodiments, the illumination source may include a laser system configured to emit continuous wave (CW) laser radiation. For example, in settings where the gas of the volume is or includes argon, the illumination source may include a CW laser (e.g., fiber laser or disc Yb laser) configured to emit radiation at 1069 nm. It is noted that this wavelength fits to a 1068 nm absorption line in argon and as such is particularly useful for pumping the gas. It is noted herein that the above description of a CW laser is not limiting and any CW laser known in the art may be implemented in the context of the present invention.

In another embodiment, the illumination source may include one or more diode lasers. For example, the illumination source may include one or more diode lasers emitting radiation at a wavelength corresponding with any one or more absorption lines of the species of the gas of the plasma cell. In a general sense, a diode laser of the illumination source may be selected for implementation such that the wavelength of the diode laser is tuned to any absorption line of any plasma (e.g., ionic transition line) or an absorption line of the plasma-producing gas (e.g., highly excited neutral transition line) known in the art. As such, the choice of a given diode laser (or set of diode lasers) will depend on the type of gas utilized in the plasma cell of the present invention.

In some embodiments, the illumination source may include one or more frequency converted laser systems. For example, the illumination source may include a Nd:YAG or Nd:YLF laser. In other embodiments, the illumination source may include a broadband laser. In other embodiments, the illumination source may include a laser system configured to emit modulated laser radiation or pulse laser radiation.

In another aspect of the present invention, the illumination source may include two or more light sources. In one embodiment, the illumination source may include two or more lasers. For example, the illumination source (or illumination sources) may include multiple diode lasers. By way of another example, the illumination source may include multiple CW lasers. In a further embodiment, each of the two or more lasers may emit laser radiation tuned to a different absorption line of the gas or plasma within the plasma cell.

Various embodiments are described herein for a semiconductor processing system (e.g., an inspection system or a lithography system) that may be used for processing a specimen. The term "specimen" is used herein to refer to a wafer, a reticle, or any other sample that may be processed (e.g., printed or inspected for defects) by means known in the art.

As used herein, the term "wafer" generally refers to substrates formed of a semiconductor or non-semiconductor material. Examples include, but are not limited to, monocrystalline silicon, gallium arsenide, and indium phosphide. Such substrates may be commonly found and/or processed in semiconductor fabrication facilities. In some cases, a wafer may include only the substrate (i.e., bare wafer). Alternatively, a wafer may include one or more layers of different materials formed upon a substrate. One or more layers formed on a wafer may be "patterned" or "unpatterned." For example, a wafer may include a plurality of dies having repeatable pattern features.

A "reticle" may be a reticle at any stage of a reticle fabrication process, or a completed reticle that may or may not be released for use in a semiconductor fabrication facility. A reticle, or a "mask," is generally defined as a substantially transparent substrate having substantially opaque regions formed thereon and configured in a pattern. The substrate may include, for example, a glass material such as quartz. A reticle may be disposed above a resist-covered wafer during an exposure step of a lithography process such that the pattern on the reticle may be transferred to the resist.

One or more layers formed on a wafer may be patterned or unpatterned. For example, a wafer may include a plurality of dies, each having repeatable pattern features. Formation and processing of such layers of material may ultimately result in completed devices. Many different types of devices may be formed on a wafer, and the term wafer as used herein is intended to encompass a wafer on which any type of device known in the art is being fabricated.

In one or more exemplary embodiments, the functions described may be implemented in hardware, software, firmware, or any combination thereof. If implemented in software, the functions may be stored on or transmitted over as one or more instructions or code on a computer-readable medium. Computer-readable media include both computer storage media and communication media including any medium that facilitates transfer of a computer program from one place to another. A storage media be any available media that can be accessed a general purpose or special purpose computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code means in the form of instructions or data structures and that can be accessed by a general-purpose or special-purpose computer, or a general-purpose or special-purpose processor. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and blu-ray disc where disks usually reproduce data magnetically, while discs reproduce data optically with lasers. Combinations of the above should also be included within the scope of computer-readable media.

Although certain specific embodiments are described above for instructional purposes, the teachings of this patent document have general applicability and are not limited to the specific embodiments described above. Accordingly, various modifications, adaptations, and combinations of various features of the described embodiments can be practiced without departing from the scope of the invention as set forth in the claims.

What is claimed is:

1. A laser sustained plasma light source, comprising:

a laser operable to generate an amount of illumination light; and a plasma bulb having at least one wall operable in part to contain a working gas and an amount of water, wherein the illumination light generated by the laser is incident on the working gas and generates a laser sustained plasma emission, wherein a portion of the laser sustained plasma emission is absorbed by the water without being incident on the at least one wall of the bulb.

2. The laser sustained plasma light source of claim 1, wherein a partial pressure of water in the plasma bulb is greater than 0.001 bar.

3. The laser sustained plasma light source of claim 1, wherein a shape of the plasma bulb includes any of a substantially spherical shape, a substantially cylindrical shape, a substantially ellipsoidal shape, and a substantially prolate spheroid shape.

4. The laser sustained plasma light source of claim 1, wherein the working gas comprises at least one gas taken from the list consisting of: Ar, Kr, Xe, He, Ne, $N_2$, $Br_2$, $Cl_2$, $I_2$, $H_2O$, $O_2$, $H_2$, $CH_4$, NO, $NO_2$, $CH_3OH$, $C_2H_5OH$, $CO_2$, $NH_3$, one or more metal halides, a Ne/Xe mixture, an Ar/Xe mixture, a Kr/Xe mixture, an Ar/Kr/Xe mixture, an ArHg mixture, a KrHg mixture, and a XeHg mixture.

5. The laser sustained plasma light source of claim 1, wherein the plasma bulb is formed from a glass material.

6. The laser sustained plasma light source of claim 5, wherein the glass material includes a fused silica glass material.

7. The laser sustained plasma light source of claim 1, wherein the plasma bulb is formed from a crystalline material.

8. The laser sustained plasma source of claim 7, wherein the crystalline material includes any of a crystalline quartz material and a sapphire material.

9. The laser sustained plasma light source of claim 1, wherein a partial pressure of water in the plasma bulb is greater than 0.01 bar.

10. The laser sustained plasma light source of claim 1, further comprising:

a heating element operable to change a temperature of the plasma bulb in a region of the plasma bulb that contains an amount of condensed water; and a controller operable to control the change in temperature of the plasma bulb.

11. The laser sustained plasma light source of claim 1, wherein the amount of water includes an amount of water vapor and an amount of condensed water vapor.

12. The laser sustained plasma light source of claim 1, wherein the water includes any isotope of $H_2O$.

13. A method comprising:

stimulating a laser sustained plasma emission in a plasma bulb comprising a working gas and an amount of water; and absorbing an amount of the laser sustained plasma emission before the amount of the laser sustained plasma emission interacts with a wall of the plasma bulb, the amount of the laser sustained plasma emission is absorbed by the amount of water; and collecting an amount of the laser sustained plasma emission transmitted through the wall of the plasma bulb.

14. The method of claim 13, wherein the amount of water includes an amount of water vapor and an amount of condensed water vapor.

15. The method of claim 14, further comprising:

controlling the amount of water vapor by controlling a temperature of the plasma bulb in a region of the plasma bulb that contains the amount of condensed water vapor.

16. The method of claim 13, wherein a shape of the plasma bulb includes any of a substantially spherical shape, a substantially cylindrical shape, a substantially ellipsoidal shape, and a substantially prolate spheroid shape.

17. The method of claim 13, wherein the water includes any isotope of $H_2O$.

18. The method of claim 13, wherein a partial pressure of water in the plasma bulb is greater than 0.001 bar.

19. An apparatus comprising:

a laser operable to generate an amount of illumination light;

a plasma bulb having at least one wall operable in part to contain a working gas and an amount of water, wherein the illumination light generated by the laser is incident on the working gas and generates a laser sustained plasma emission, wherein a portion of the laser sustained plasma emission is absorbed by the water without being incident on the at least one wall of the bulb; and a computer configured to control an amount of water vapor in the plasma bulb by controlling a temperature of the plasma bulb.

20. The apparatus of claim 19, wherein the controlling the temperature of the plasma bulb involves:

receiving an indication of a temperature of the plasma bulb; and determining an output signal to be communicated to a heating element based at least in part on the indication of the temperature of the plasma bulb, wherein the output signal causes the heating element to add an amount of heat to the plasma bulb.

* * * * *